US006445888B1

(12) United States Patent
Fujiwara et al.

(10) Patent No.: US 6,445,888 B1
(45) Date of Patent: Sep. 3, 2002

(54) IMAGE FORMING APPARATUS HAVING A DETACHABLE CARTRIDGE AND DEVELOPER RESIDUAL AMOUNT SENSOR

(75) Inventors: Kazumasa Fujiwara; Shigeru Morimoto; Kiyoshi Sakoh; Toru Isosu, all of Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/686,966

(22) Filed: Oct. 12, 2000

(30) Foreign Application Priority Data

Oct. 12, 1999 (JP) ..... 11-290127

(51) Int. Cl.[7] ..... G03G 15/08
(52) U.S. Cl. ..... 399/27; 399/30
(58) Field of Search ..... 399/13, 27, 30, 399/74, 61–64, 111, 119

(56) References Cited

U.S. PATENT DOCUMENTS 5,428,427 A * 6/1995 Lee ..... 399/30
5,784,665 A * 7/1998 Bae ..... 399/27 X
5,893,007 A * 4/1999 Lim ..... 399/27 X
6,148,156 A * 11/2000 Matsumoto ..... 399/30

FOREIGN PATENT DOCUMENTS

JP 9-244387 9/1997
JP 10-198154 7/1998

* cited by examiner

*Primary Examiner*—William J. Royer
(74) *Attorney, Agent, or Firm*—Morgan, Lewis & Bockius LLP

(57) ABSTRACT

An image forming apparatus includes an image forming apparatus body having a space in which a cartridge is mounted, a developer residual amount sensor having a cartridge confronting face, a supported face, a sensor head and an inclination regulating projection member and serves to detect the amount of developer, a sensor holder having a sensor supporting face for supporting the supported face and a sensor holding portion for holding the developer residual amount sensor, and a fulcrum member which is rotatable with respect to the tip portion thereof as a fulcrum.

12 Claims, 8 Drawing Sheets

IMAGE FORMING APPARATUS HAVING A DETACHABLE CARTRIDGE AND DEVELOPER RESIDUAL AMOUNT SENSOR

BACKGROUND OF THE INVENTION

1. Field of the Invention

The present invention relates to an image forming apparatus adopting an electrophotographic system such as a copy machine, FAX (facsimile machine) or a printer, and particularly to an image forming apparatus including an image forming apparatus body having a cartridge mount space in which a cartridge having a developer container is mounted, a cartridge which is loaded from the upper side of the image forming apparatus body and detachably mounted in the cartridge mount space, and a developer residual amount sensor which is supported so as to be pressed against the outer wall of the developer container of the cartridge when the cartridge is mounted in the cartridge mount space.

2. Description of the Related Art

According to the image forming apparatus of the above type, the developer residual amount sensor for detecting the residual amount of the developer in a developer container is used, and when the residual amount of the developer is reduced, it is displayed on a display of a user's interface that the residual amount of the developer is small. According to the display content on the. display, the user carries out a cartridge exchange work.

The developer residual amount sensor described above is disposed so that the outer wall of the developer container is pressed against the developer residual amount detection face of the developer residual amount sensor when the cartridge having the developer container is loaded in the cartridge mount space of the image forming apparatus body. If the outer wall of the developer container and the developer residual amount detection face of the developer residual amount sensor are not brought into close contact with each other and thus a gap occurs between them, the detection sensitivity of the developer residual amount sensor is reduced and some detection miss occurs.

In order to bring the developer residual amount detection face in close contact with the outer wall of the developer container when the outer wall of the developer container is pressed against the developer residual amount detection face of the developer residual amount sensor, the developer residual amount sensor is required to be supported so that the developer residual amount detection face thereof can be freely inclined. Particularly in the case of a developer residual amount sensor using a magnetic sensor, the output of the developer residual amount sensor is varied due to minute variation in the distance between the outer wall of the developer container and the developer residual amount detection face, and thus "close contact" is required (i.e., it is required that they are brought into close contact with each other).

The following technique on a developer residual amount sensor designed so that the developer residual amount detection face thereof can be inclined is well known.

According to the technique disclosed in Japanese Laid-Open Patent Application No. Hei-10-198154, a supported face of the developer residual amount sensor which is located at the opposite side of the cartridge confront face of the developer residual amount sensor on which the developer residual amount detection face is provided is supported by the tip of a pin so that the developer residual amount detection face can be inclined. In this technique, as the developer residual amount detection face is larger, the developer residual amount detection face is more liable to be inclined along the outer wall of the developer container, so that the developer residual amount detection face is more liable to come into close contact with the outer wall of the developer container. However, as the developer residual amount detection face is smaller, the developer residual mount detection face is less liable to be inclined along the outer wall of the developer container, so that the position of the developer residual amount sensor is unstable and thus erroneous detection is more liable to occur.

SUMMARY OF THE INVENTION

Accordingly, the present invention is directed to an image forming apparatus that substantially obviates one or more of the problems due to the limitations and disadvantages of the related art.

An object of the present invention is to provide an image forming apparatus including: an image forming apparatus body having a cartridge mount space in which a cartridge having a developer container filled with developer is detachably mounted; a sensor that detects a residual amount of the developer, the sensor being brought into contact with the outer wall of the developer container when the cartridge is mounted in the cartridge mount space; a holding member that fixedly holds the sensor; and a support member which rotatably supports the holding member so that the sensor is positionally variable so as to come into contact with the outer wall of the developer container.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

Figure 1:
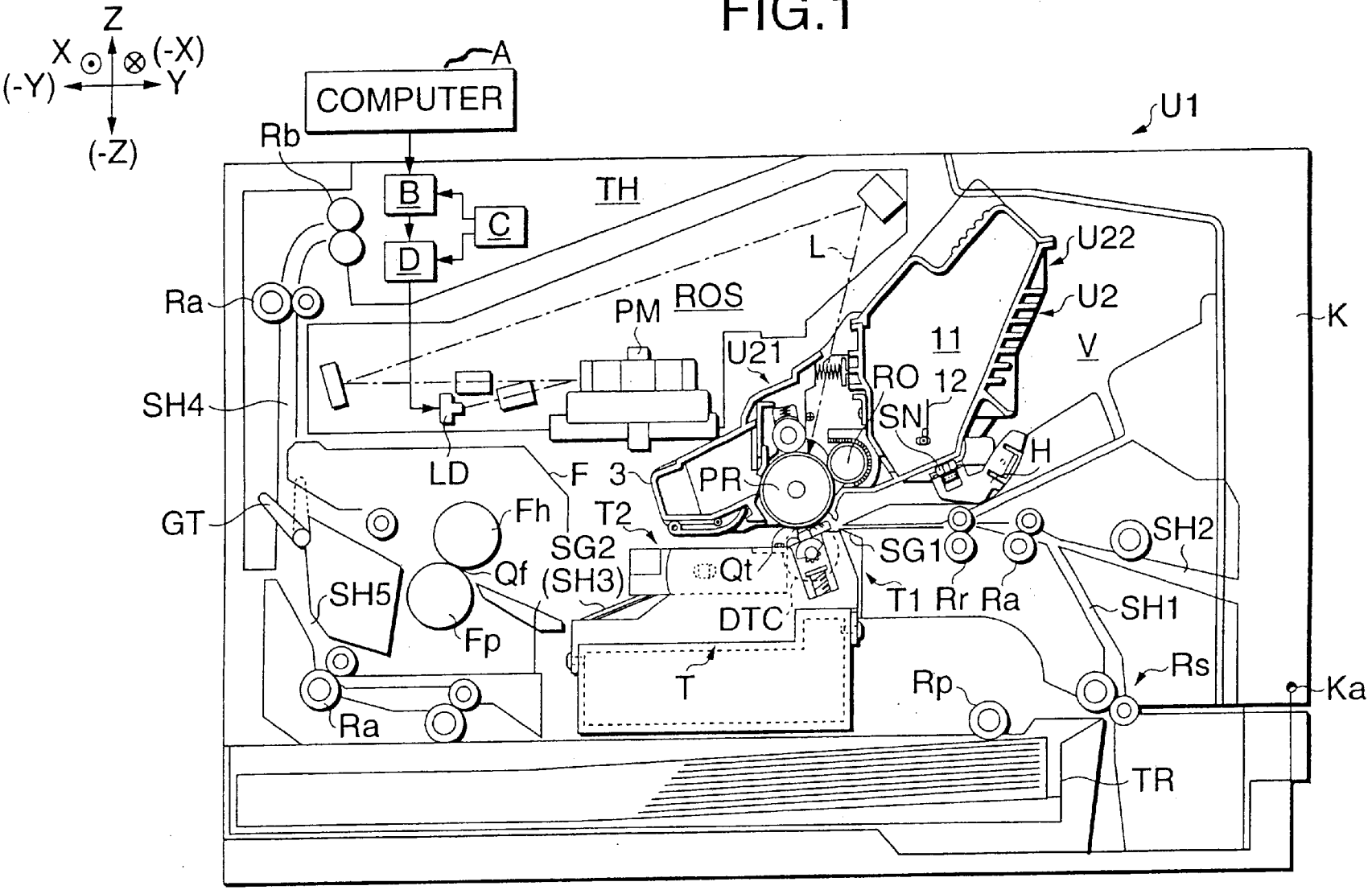
FIG. 1 is a diagram showing the overall construction of a printer as an image forming apparatus according to a first embodiment of the present invention, to which an electrophotographic system is applied.

Preferred embodiments of the image forming apparatus according to the present invention will be described hereunder with reference to the accompanying drawings, however, the present invention is not limited to these embodiments.

In order to make the understanding of the following description easier, in the drawings, the forward-and-backward direction is set as an X-axis direction, the right-and-left direction is set as a Y-axis direction and the up-and-down direction is set as a Z-axis direction. The directions or sides indicated by arrows X, −X, Y, −Y, Z, −Z represent the forward direction, the backward direction, the right direction, the left direction, the upward direction and the downward direction, or the front side, the back side, the right side, the left side, the upper side and the lower side. Further, in the drawings, a mark "⊙" means an arrow directing from the back side to the front side with respect to the surface of the drawing, and a mark "ⓧ" represents an arrow directing from the front side to the back side with respect to the surface of the drawing. (First Embodiment)

Figure 2:
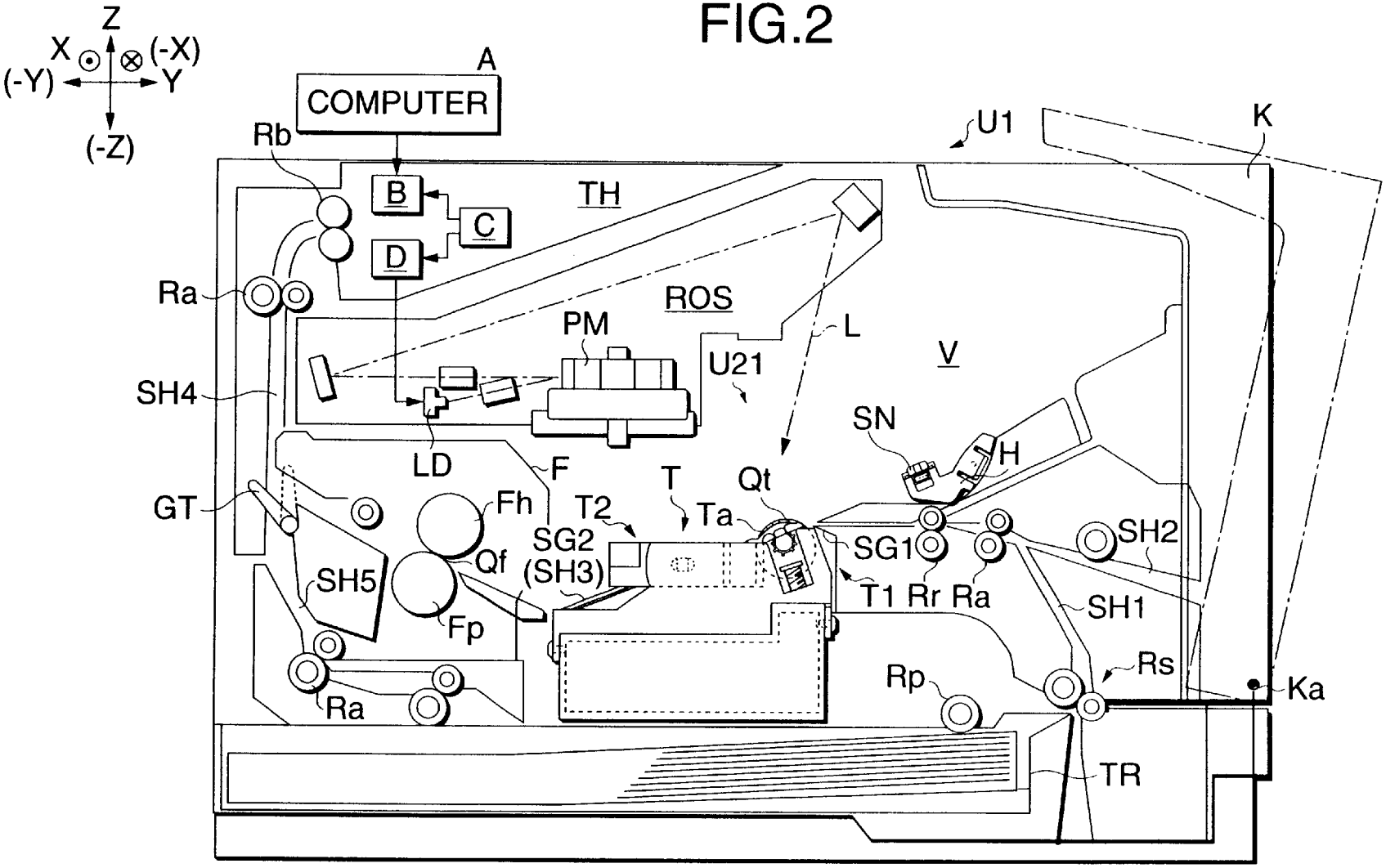
FIG. 2 is a diagram showing the body of the printer of the first embodiment of FIG. 1.
Figure 3:
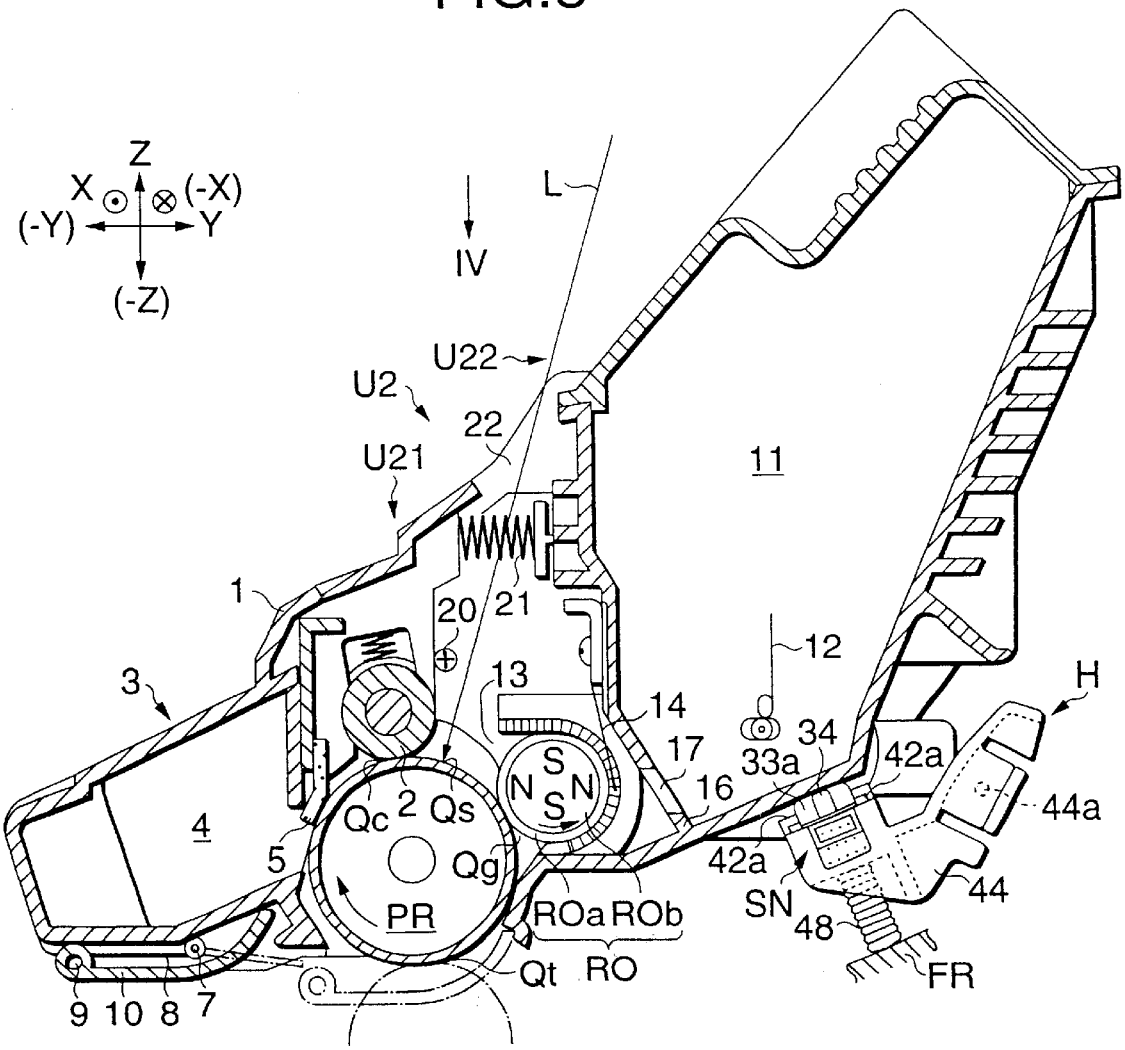
FIG. 3 is a diagram showing a process cartridge which is detachably loaded and mounted in the body of the printer of the first embodiment.
Figure 4:
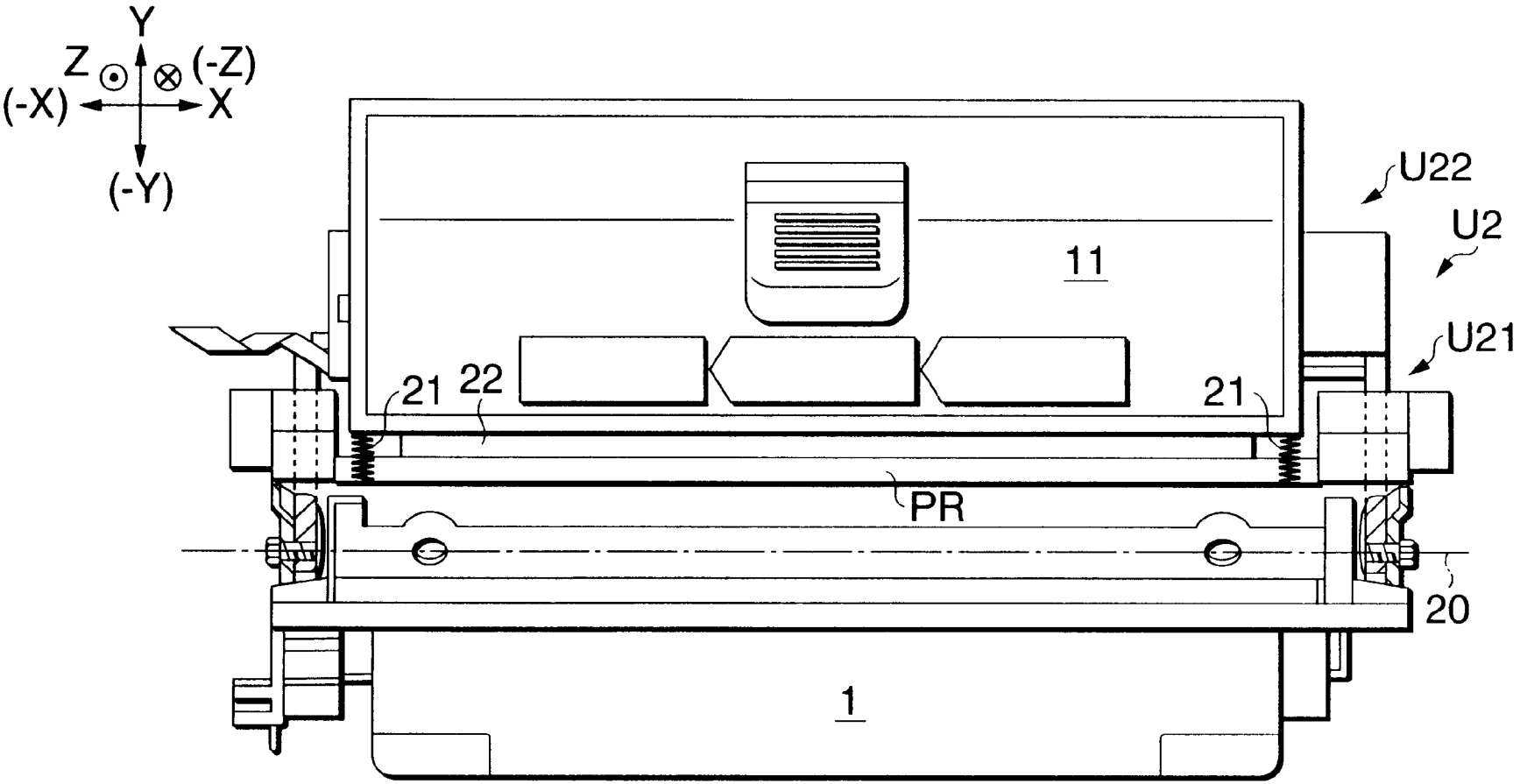
FIG. 4 is a diagram viewed from the direction indicated by an arrow IV of FIG. 3.

FIG. 1 shows the overall construction of a printer as an image forming apparatus of a first embodiment to which an electrophotographic system of the present invention is applied, FIG. 2 is a diagram showing the body of the printer of the first embodiment, FIG. 3 is a diagram showing a process cartridge which is freely detachably mounted in the body of the printer of the first embodiment, and FIG. 4 is a view taken along an arrow IV of FIG. 3.

In FIG. 1, the printer (image forming apparatus) of the first embodiment of the present invention has a printer body (image forming apparatus body) U1 and a cartridge U2 which is freely detachably loaded and mounted in the printer body U1.

(Printer Body U1)

The printer body U1 has a local memory for receiving image data transmitted from an external computer A and temporarily stores the image data thus received, and also has an image processor B for outputting laser driving data corresponding to the received image data stored in the local memory, a laser driving circuit D for receiving the laser driving data output from the image processor B, and a controller C for controlling the operation of the image processor B and the laser driving circuit D.

The laser driving circuit D outputs the laser driving signal corresponding to the input laser driving data to ROS (latent image forming apparatus).

ROS is a device for writing an electrostatic latent image on the surface of PR (photoreceptor) of the cartridge U2 described later, and is equipped with a laser diode LD for emitting a laser beam (light beam) L modulated by the laser driving signal, and a scanning optical system having a rotational polygonal mirror (polygon mirror) PM.

The printer body U1 has a sheet feed tray TR at the lower portion thereof, and a pick-up roller Rp for picking up a recording sheet from the sheet feed tray TR is disposed at the upper and right (−Y) side thereof. A retard roller Rs having a pair of rollers is disposed at the right side of the pickup roller Rp. The retard roller Rs has a function of separating recording sheets picked up from the pickup roller Rp one by one and feeding each recording sheet to a sheet feeding path SH1.

A feeding roller Ra and a registration roller Rr are disposed in the sheet feeding path SHI. Further, a manual sheet feeding path SH2 is connected to the sheet feeding path SHI at the upstream side of the feeding roller Ra.

A pre-transfer sheet guide SG1 is disposed at the left side of the registration roller Rr, and a transfer unit T is disposed at the left side of the pre-transfer sheet guide SG1. The transfer unit T serves to transfer onto a recording sheet a toner image on the photoreceptor PR of the cartridge U2 described later, and is equipped with a transfer unit body T1 having a post-transfer sheet guide SG2 (SH3), a transfer roll mount member T2 supported by the transfer unit body T1, a transfer roll mounted in the transfer roll mount member T2, a discharger DTC supported by the transfer roll mount member T2.

A transfer area Qt is formed by the contact area between the photoreceptor PR and the transfer roll Ta on which the transfer roll mount member T2 is detachably mounted.

A fixing device F disposed at the left side of the transfer unit T has a heating roll Fh and a pressure roll Fp, and a fixing area Qf is formed in the contact area between both the rolls Fh and Fp. The heating roll Fh has a built-in halogen heater, and an unfixed toner image on the recording sheet passed through the fixing area Qf is heated and fixed.

A recording sheet discharging path SH4 and a recording sheet inverting path SH5 are provided at the left side of the fixing device F. A feeding roller Ra and a discharge roller Rb are provided in the recording sheet discharging path SH4, and the feeding roller Ra is provided in the recording sheet inverting path SH5. A switching gate GT for switching the feeding direction of the recording sheet is provided at the connection portion between the recording sheet discharging path SH4 and the recording sheet inverting path SH5.

The switching gate GT is ordinarily kept at a position (solid-line position) at which the recording sheet discharged from the fixing device F is fed to the recording sheet discharging path SH4. When one-side recording (print on one surface of the recording sheet) is carried out, the recording sheet one surface of which has been subjected to the recording is discharged from the discharge roller Rb of the recording sheet discharging path SH4 to a discharge tray TH.

When both-side recording is carried out on the recording sheet, the switching gate GT is switched to a two-dotted chain line position so that the recording sheet one side of which has been subjected to the recording is temporarily fed to the recording sheet discharging path SH4 side and then it is switched back and fed to the recording sheet inverting path SH5.

The recording sheet which is switched back and fed to the recording sheet inverting path SH5 is stocked in the sheet feed tray TR while being inverted. When the recording sheet thus inverted is picked up from the sheet feed tray TR and fed to the transfer area Qt (the contact area between the photoreceptor PR and the transfer roll Ta), a toner image is transferred onto the opposite surface to the surface on which the recording was first carried out. The recording sheet which has been subjected to the image recording at both the surfaces thereof is discharged from the discharge roller Rb to the discharge tray TH.

A cartridge mount space V is formed at the upper side of the transfer unit T, the registration roller Rr. An open/close door K for opening/closing the cartridge mount space V is supported at the right side of the cartridge mount space V so as to be rotatable around a shaft Ka. The cartridge U2 is insertable (loadable ) or detachable from/to the upper and right side of the printer body U1.

A developer residual amount sensor SN and a sensor holder H for holding the developer residual amount sensor SN are disposed at the upper side of the registration roller Rr. The sensor holder H and the developer residual amount sensor SN will be described later.

(Cartridge U2)

In FIGS. 3 and 4, the cartridge U2 has a photoreceptor unit U21 and a developing unit U22.

The photoreceptor unit U21 has a case 1 constituting the outer wall thereof, a photoreceptor PR supported by the case 1, a charging roll 2 for uniformly charging the surface of the photoreceptor PR in the charging area Qc, and a cleaner 3 for withdrawing toner adhering to the surface of the photoreceptor PR.

The photoreceptor PR is constructed by forming a surface layer of OPC (organic photoreceptor) on the surface of an aluminum cylindrical base material. Since OPC is liable to be negatively charged, an AC voltage superposed with a DC bias voltage is applied to the charging roll 2. The voltage to be applied to the charging roll 2 is supplied from a power source circuit (not shown) of the printer body U1 when the cartridge U2 is mounted in the printer body U1. Various well-known structures may be adopted as a structure for supplying current from the printer body U1 to the cartridge U2. The aluminum cylindrical base material of the photoreceptor PR is grounded.

The first embodiment of the present invention is designed so as to carry out an image exposing operation, and a laser beam L is irradiated to an image portion (a portion on the recording sheet in which toner is put) on the photoreceptor PR at the latent image forming position Qs.

The cleaner 3 has a toner withdrawing container 4 formed by the case 1 and a cleaning blade 5, and the tip of the cleaning blade 5 abuts against the photoreceptor PR. In the first embodiment, an urethane blade having high rigidity is used as the cleaning blade 5. The residual toner on the photoreceptor PR is scraped by the cleaning blade 5 and then stocked in the toner withdrawing container 4.

In FIG. 3, one end of a leaf spring 8 is supported at the lower portion of the toner withdrawing container 4 so as to be freely rotatable around a hinge shaft 7. A protection cover 10 is linked to the other end of the leaf spring 8 through a hinge shaft 9.

When the leaf spring 8 is rotated around the hinge shaft 7, the protection cover 10 is movable between a closed position indicated by a two-dotted chain line and an open position indicated by a solid line in FIG. 3. The protection cover 10 is kept at the closed position indicated by the two-dotted chain line of FIG. 3 to cover the lower portion of the photoreceptor PR before the cartridge U2 is mounted in the printer body U1, and it is moved to the open position indicated by the solid line when the cartridge U2 is loaded and mounted in the printer body U1.

The photoreceptor unit U21 is constructed by the elements indicated by reference numerals 1 to 5 and 7 to 10 described above.

The developing unit U22 has a developer container 11 for stocking one-component magnetic toner, and an agitator (toner stirring member) 12 which is rotatably supported in the developer container 11. A developing roll R0 is supported in a developing roll accommodating portion 13 which is integrally formed on the outer side surface of the developer container 11.

The developing roll R0 is constructed by a sleeve (that is, developer carrying member) R0*a* formed of a rotatable aluminum pipe and a magnet roll R0*b* fixedly supported in the sleeve R0*a*. The magnet roll R0*b* in the sleeve R0*a* has a developing pole N located so as to confront the photoreceptor PR, a layer forming pole N located at the upstream side portion adjacent to a layer thickness regulating member 14 for regulating the layer thickness of the developer on the sleeve R0*a*, and two carry poles S which are located between the N poles and serve to surely hold toner under suction on the sleeve R0*a*.

When the cartridge U2 is mounted in the printer body U1, a voltage obtained by superposing an AC voltage with a minus DC bias voltage is applied from a power source circuit (not shown) to the sleeve R0*a* of the developing roll R0. As described above, the aluminum cylindrical base material of the photoreceptor PR is grounded, so that the AC voltage superposed with the minus DC bias voltage is applied to the developing area Qg in which the photoreceptor PR and the sleeve R0a are confronted to each other. The negatively-charged toner on the sleeve R0*a* is moved to the electrostatic latent image side on the photoreceptor PR by the applied voltage, whereby the electrostatic latent image is developed into a toner image.

An opening 17 is formed at the upper side of a partition wall 16 provided between the developer container 11 and the developing roll accommodating portion 13 on the bottom surface of the developer container 11. The position of the upper end surface of the partition wall 16 is set to a proper height (lower than the height of the contact portion between the sleeve R0*a* and the layer thickness regulating member 14) so that the toner can easily move from the developer container 11 through the opening 17 to the developing roll R0 side.

The developing unit U22 is constructed by the above elements indicated by reference numerals 11 to 14, 16 and 17 and R0.

In FIGS. 3 and 4, the photoreceptor unit U21 and the developing unit U22 are linked to each other so as to be relatively rotatable around the axis 20 at both the ends in the forward and backward direction (both ends in X-axis direction). The photoreceptor U21 and the developing unit U22, which are relatively rotatable, are urged by a compression spring 21 so as to be opened around the axis 20 (see FIGS. 3, 4). This urging force causes the developing roll R0 to be pressed against the photoreceptor PR. The sleeve R0*a* of the developing roll R0 and the photoreceptor PR are set so that the outer end portions thereof in the axial direction, that is, the outside portions thereof in the axial direction (X-axis direction) of the developing area are brought into contact with each other, and a proper gap is kept in the developing area Qg between the sleeve R0*a* and the photoreceptor PR.

A transfer area Qt in which the photoreceptor PR and the transfer roll Ta are brought into contact with each other is formed at the downstream side of the developing area Qg along the surface of the photoreceptor PR.

A beam incident opening 22 through which the laser beam L for writing a latent image is irradiated to the photoreceptor PR is formed between the photoreceptor unit U21 and the developing unit U22.

The cartridge U2 is constructed by the elements indicated by reference numerals 20 to 22, the photoreceptor unit U21 and the developing unit U22.

(Developer Residual Amount Sensor)

Figure 5A:
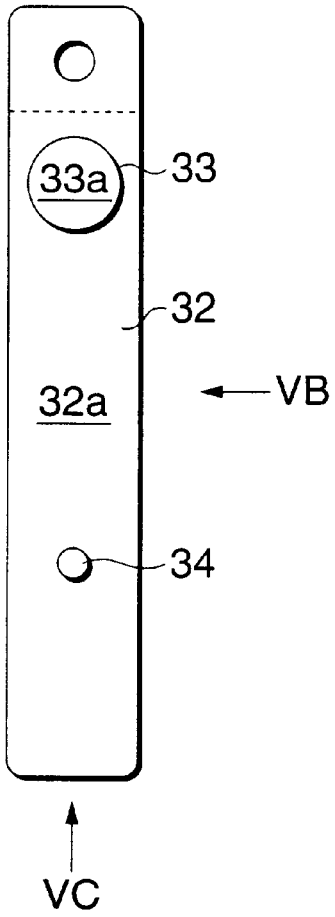
FIG. 5A is a top view of a developer residual amount sensor.
Figure 5B:
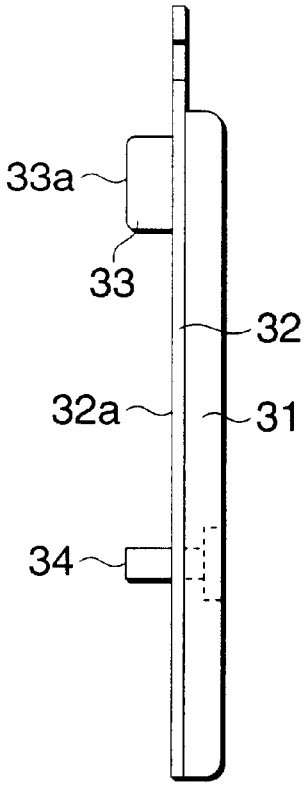
FIG. 5B shows the developer residual amount sensor which is viewed from the direction indicated by an arrow VB of FIG. 5A.
Figure 5C:
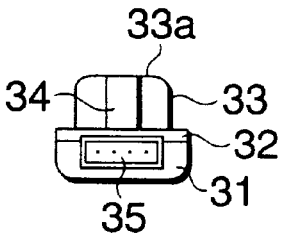
FIG. 5C shows the developer residual amount sensor which is viewed from the direction indicated by an arrow VC of FIG. 5A.

FIGS. 5A to 5C show a developer residual amount sensor, wherein FIG. 5A is a top view of the developer residual amount sensor, FIG. 5B is a diagram viewed from an arrow VB of FIG. 5A, and FIG. 5C is a diagram viewed from an arrow VC of FIG. 5A.

In FIG. 5A to 5C, the developer residual amount sensor SN held by the sensor holder H has a case 31 having an outer shape of rectangular parallelepiped and an upper lid 32 for closing the upper end opening of the case 31. A sensor head 33 projecting outwardly and a contact pin (inclination regulating projection member) 34 are disposed on the upper surface (cartridge confronting surface) 32*a* of the rectangular upper lid 32 so to be away from each other in the longitudinal direction. A connector 35 (see FIG. 5C) is provided on one end surface of the case 31.

The inside of the case 31 and the inside of the sensor head 33 intercommunicate with each other. A sensor board (not shown) is accommodated in the case 31, and a magnetic sensor (for detecting the presence or absence of magnetic developer in the developer container 11) (not shown) is accommodated in the sensor head 33. The detection precision could be enhanced if the magnetic sensor issued while the developing agent residual amount detection face 33*a* formed at the tip surface of the sensor head 33 is brought into close contact with the outer wall of the developer container 11. Therefore, the developer residual amount sensor SN is used under the state that the developer residual amount detection face 33*a* thereof is brought into close contact with the outer wall of the developer container 11.

Figure 6A:
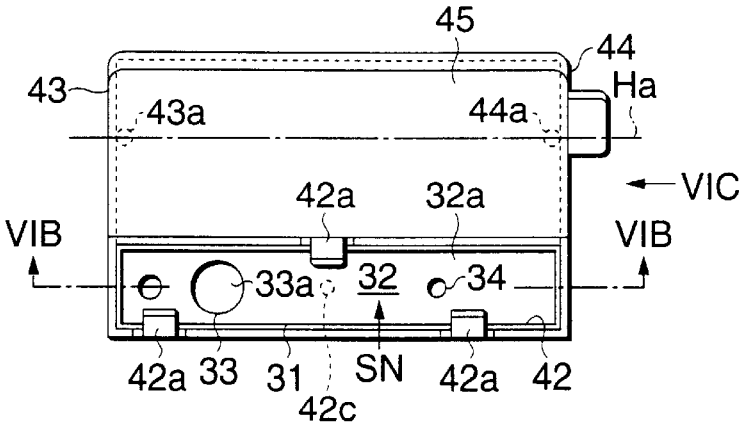
FIG. 6A is a top view of a developer residual amount sensor and a holder for holding the sensor.
Figure 6C:
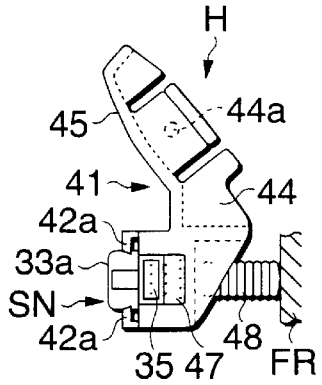
FIG. 6C shows the sensor and the holder viewed from the direction indicated by an arrow VIC of FIG. 6A.
Figure 6B:
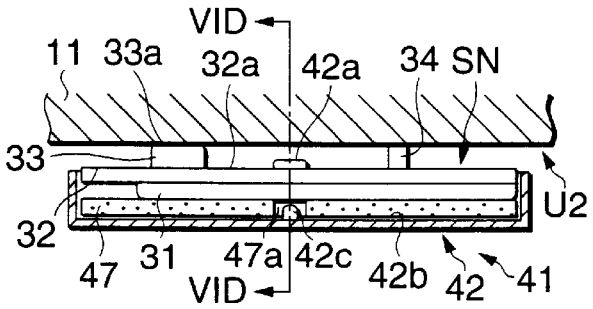
FIG. 6B is a cross-sectional view taken along VIB—VIB line of FIG. 6A.
Figure 6D:
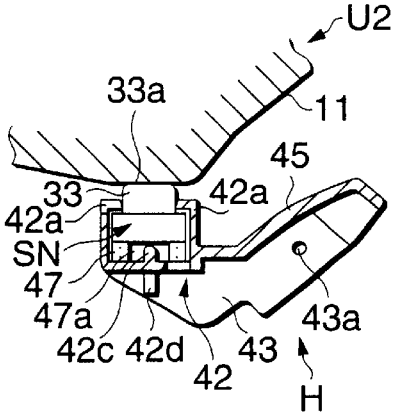
FIG. 6D is a cross-sectional view taken along VID—VID line of FIG. 6B.
Figure 6E:
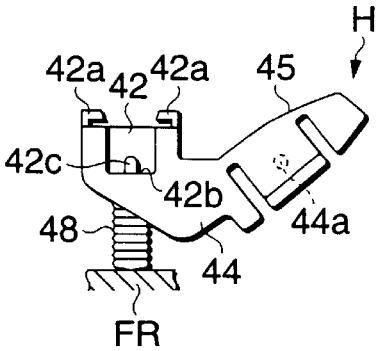
FIG. 6E is a diagram showing such a state that the developer residual amount sensor of FIG. 6C is removed.
Figure 6F:
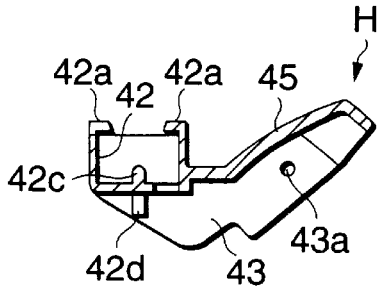
FIG. 6F is a diagram showing such a state that the developer residual amount sensor of FIG. 6D is removed.

FIGS. 6A to 6F show the developer residual amount sensor SN and the sensor holder for holding the sensor, wherein FIG. 6A is a top view of the developer residual amount sensor SN, FIG. 6B is a cross-sectional view taken along VIB—VIB of FIG. 6A, FIG. 6C is a diagram viewed from an arrow VIC of FIG. 6A, FIG. 6D is a cross-sectional view taken along VID—VID of FIG. 6B, FIG. 6E is a diagram in which the developer residual amount sensor SN of FIG. 6C is removed, and FIG. 6F is a diagram in which the developer residual amount sensor SN of FIG. 6D is removed.

In FIG. 6A, the sensor holder H for holding the developer residual amount sensor SN has a holder body 41. The holder body 41 has a sensor holding portion 42 for holding the developer residual amount sensor SN, a pair of side walls 43, 44, and an upper wall portion 45 for connecting the sensor holding portion 42 and an upper end portion of the pair of the side walls 43, 44.

The sensor holding portion 42 has a sensor accommodating space of rectangular parallelepiped, and is provided with three elastic engaging pawls 42*a* at the upper end thereof. A fulcrum pin (fulcrum member) 42*c* is projected from the upper surface (sensor supporting surface) 42*b* at the central portion of the bottom wall of the sensor holding portion 42, and a spring hooking pin 42*d* (see FIG. 6F) is projected from the lower surface.

In FIG. 6B, an elastic member 47 of sponge which is easily elastically compressed and deformed is mounted on the bottom wall of the sensor holding portion 42. The elastic member 47 has a through hole 47*a* through which the fulcrum pin 42*c* penetrates. The developer residual amount sensor SN elastically deforms the three elastic engaging pawls 42*a* and moves them into the sensor holding portion 42, and then it is mounted on the upper surface of the elastic member 47. The developer residual amount sensor SN mounted on the elastic member 47 is held in the sensor holding member 42 while abutting against the lower surfaces of the three elastic engaging pawls 42*a* by the elastic force of the elastic member 47. Under this state, a predetermined gap is formed between the tip (upper end) of the fulcrum pin 42*c* and the lower surface of the developer residual amount sensor SN.

When the outer wall of the developer container 11 is pressed against the developer residual amount sensor SN mounted on the elastic member 47 from the upper side, the developer residual amount sensor SN is first moved downwardly while compressing the elastic member 47. At this time, if the outer wall of the developer container 11 is inclined, the developer residual amount sensor S N is inclined along the sensor inclination direction corresponding to the direction connecting the sensor head 33 and the contact pin 34 (the longitudinal direction of the developer residual amount sensor SN of rectangular parallelepiped).

In FIGS. 3, 6A and 6C to 6F, hinge pins 43*a*, 44*a* are provided on the inner surface of the pair of side walls 43, 44 of the sensor holder H, and a hinge shaft Ha is formed in the linear direction connecting the hinge pins 43*a* and 44*a*. The hinge pins 43*a* , 44*a* are supported through pin support holes (not shown) of the frame FR of the printer so as to be rotatable around the hinge shaft Ha. The direction of the hinge shaft Ha is set to be parallel to the sensor inclination direction (the direction connecting the sensor head 33 and the contact pin 34).

A return spring 48 is disposed between the sensor holder H and the frame FR of the printer body U1.

(Operation of First Embodiment)

Figure 7A:
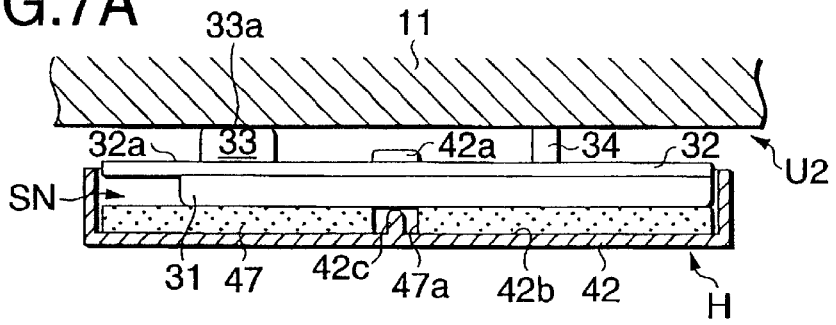
FIGS. 7A is an explanatory diagram showing the operation of the image forming apparatus of the first embodiment of the present invention when the outer wall of the developer container is parallel to the sensor holder.
Figure 7B:
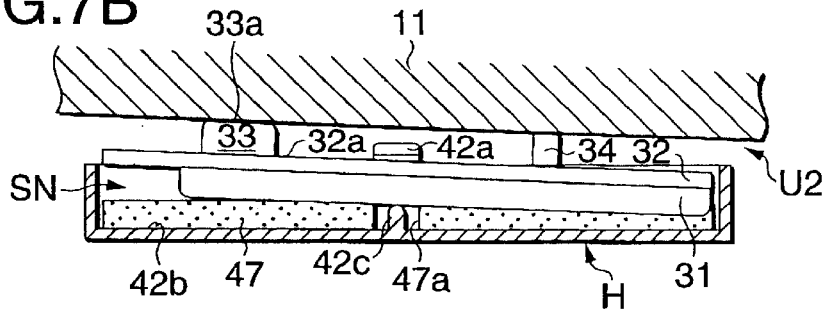
FIG. 7B is a diagram showing the image forming apparatus of FIG. 7A when the outer wall of the developer container is inclined with respect to the sensor holder.
Figure 7C:
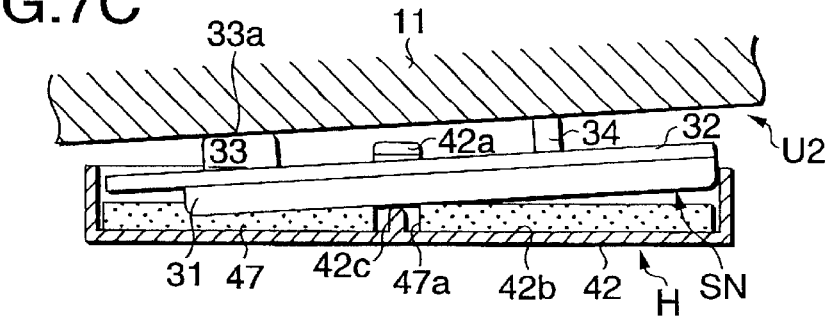
FIG. 7C is a diagram showing the image forming apparatus of FIG. 7A when the outer wall of the developer container is inclined with. respect to the sensor holder in the opposite direction to that of FIG. 7B.
Figure 7D:
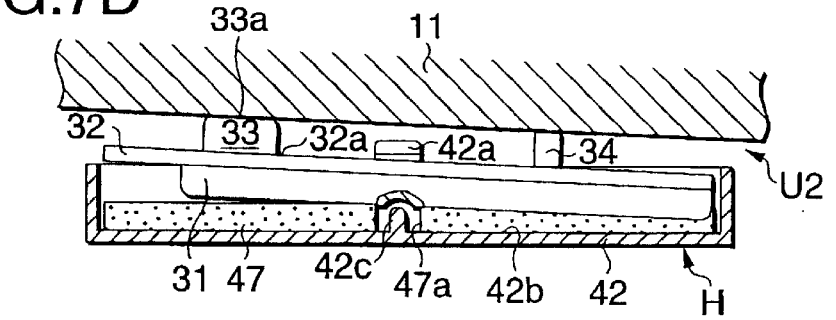
FIG. 7D is a diagram showing a modification of the developer residual amount sensor shown in FIGS. 7A to 7C.

FIGS. 7A to 7E are diagrams showing the operation of the image forming apparatus of the first embodiment according to the present invention, wherein FIG. 7A is a diagram showing a state that the outer wall of the developer container 11 is parallel to the sensor holder, FIG. 7B is a diagram showing a state that the outer wall of the developer container 11 is inclined with respect to the sensor holder, FIG. 7C is a diagram showing a state that the outer wall of the developer container 11 is inclined in the opposite direction to that of FIG. 7B with respect to the sensor holder, FIG. 7D is a diagram showing a modification of the developer residual sensor of FIGS. 7A to 7C, and FIG. 7E is an enlarged view showing the main part of FIG. 7D.

The tip of the developer residual amount detection face 33*a* and the tip of the inclination regulating projection member 34 of the developer residual amount sensor SN held in the sensor holder H which is rotatably supported in the image forming apparatus body are pressed against the outer wall of the developer container 11, whereby the developer residual amount sensor SN is rotated in a direction parallel to the sensor inclination direction corresponding to a direction connecting the sensor head 33 and the inclination regulating projection member 34. Accordingly, the developer residual amount sensor SN is brought into contact with the outer wall of the developer container 11 to stabilize the position of the developer residual amount sensor SN.

Under the state that the cartridge mount space V is empty as shown in FIG. 2, the cartridge U2 is inserted into the cartridge mount space V and mounted there as shown in FIG. 1. At this time, as is apparent from FIG. 3, the developer residual amount detection face 33*a* of the developer residual amount sensor SN held in the sensor holder H rotatably supported in the printer body (image forming apparatus body) U1 and the tip of the contact pin 34 are pressed against the outer wall of the developer container 11, whereby the developer residual amount sensor SN is rotated around the hinge pins 43*a*, 44*a*. That is, the developer residual amount sensor SN is rotated in a direction perpendicular to the axial direction connecting the hinge pins 43*a*, 44*a* (the sensor inclination direction corresponding to the direction connecting the sensor head 33 and the contact pin 34).

In FIG. 7A, when the cartridge U2 is pressed against the developer residual amount sensor SN, on the elastic member 47 mounted on the sensor holding portion 42 of the sensor holder H from the upper side thereof, the tips of the sensor head 33 and the contact pin 34 of the developer residual amount sensor SN are brought into contact with the outer wall of the developer container 11 without the developer residual amount sensor SN being inclined if the outer wall of the developer container 11 is parallel to the sensor inclination direction (the direction connecting the sensor head 33 and the contact pin 34).

In FIGS. 7B, 7C, if the outer wall of the developer container 11 is inclined with respect to the sensor inclination direction (the direction connecting the sensor head 33 and the contact pin 34), the developer residual amount detection face 33*a* at the tip of the sensor head 33 and the tip of the contact pin 34 are brought into contact with the outer wall of the developer container 11 under the state that the developer residual amount sensor SN is inclined.

As described above, not only the developer residual amount detection face 33*a* at the tip of the sensor head 33, but also the tip of the contact pin 34 are brought into contact with the outer wall of the developer container 11, whereby the position of the developer residual amount sensor SN is more stabilized as compared with the case where only the developer residual detection face 33*a* is brought into contact with the outer wall of the developer container 11. Particularly when the area of the developer residual amount detection face 33*a* is small, the position of the developer residual amount sensor SN is liable to be unstable if only the developer residual amount detection face 33*a* is brought into contact with the outer wall of the developer container 11. However, when the developer residual amount detection face 33*a* and the tip of the contact pin 34 which are located away from each other are brought into contact with the outer wall of the developer container 11 at different positions according to the first embodiment, the position of the developer residual amount sensor SN can be more stabilized.

(Modification of First Embodiment)

Figure 7E:
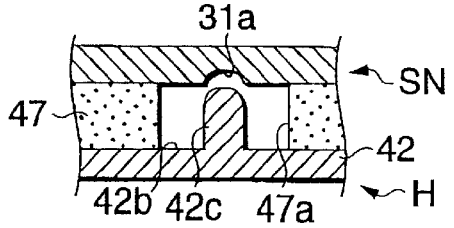
FIG. 7E is an enlarged view showing a main part of FIG. 7D)

In FIGS. 7D and 7E showing a modification of the first embodiment, a recess portion 31*a* is formed on the lower surface of the case 31 of the developer residual amount sensor SN so as to confront the tip of the fulcrum pin 42*c*. Both the tip portions of the recess portion 31*a* and the fulcrum pin 42*c* are designed in a semispherical shape.

In the modification of the first embodiment, when the developer residual amount sensor SN is pressed down by the cartridge U2, the tip of the fulcrum pin 42*c* is fitted into the recess portion 31*a*. In this state, the developer residual amount sensor SN can be rotated while positioned by the fulcrum pin 42*c*. Accordingly, the developer residual amount sensor SN is not positionally varied, and thus its position is stable.

(Second Embodiment)

Figure 8A:
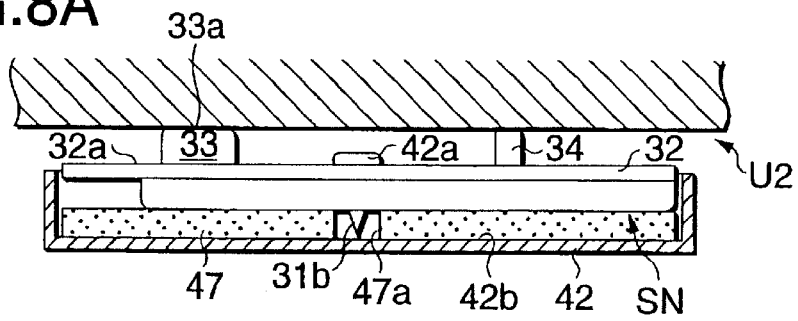
FIG. 8A shows an image forming apparatus according to a second embodiment of the present invention when the outer wall of the developer container is parallel to the sensor holder.
Figure 8B:
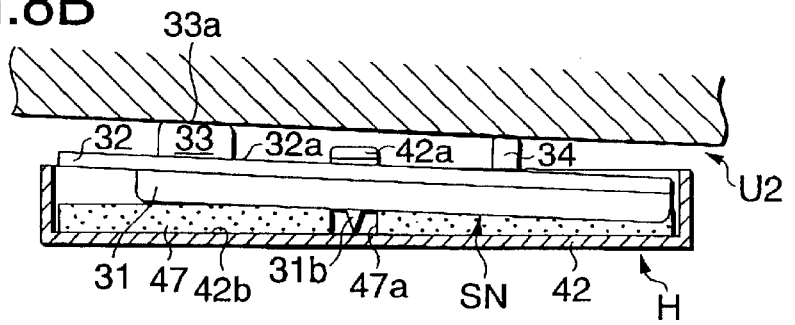
FIG. 8B is a diagram showing the image forming apparatus of FIG. 8A when the outer wall of the developer container is inclined with respect to the sensor holder.
Figure 8C:
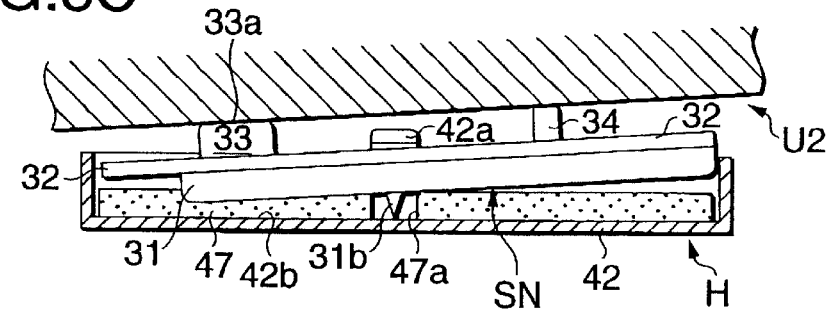
FIG. 8C is a diagram showing the image forming apparatus of FIG. 8A when the outer wall of the developer container is inclined with respect to the sensor holder in the opposite direction to that of FIG. 8B.
Figure 8D:
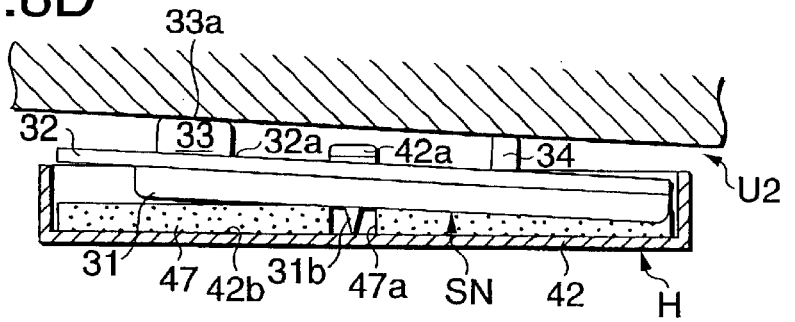
FIG. 8D is a diagram showing a modification of the developer residual amount sensor shown in FIGS. 8A to 8C.

FIGS. 8A to 8E show an image forming apparatus of a second embodiment according to the present invention, wherein FIG. 8A is a diagram showing a state that the outer wall of the developer container 11 is parallel to the sensor holder, FIG. 8B is a diagram showing a state that the outer wall of the developer container 11 is inclined with respect to the sensor holder, FIG. 8C is a diagram showing a state that the outer wall of the developer container I I is inclined in the opposite direction to that of FIG. 8B with respect to the sensor holder, FIG. 8D is a diagram showing a modification of the developer residual amount sensor shown in FIGS. 8A to 8C, and FIG. 8E is an enlarged view showing the main part of FIG. 8D.

In the following description on the second embodiment, the constituent elements corresponding to those of the first embodiment are represented by the same reference numerals as the first embodiment, and the detailed description thereof is omitted.

The second embodiment is different from the first embodiment in the following points, however, the other construction is the same as the first embodiment.

In FIGS. 8A to 8E, the fulcrum pin 42*c* provided to the sensor holder H shown in FIGS. 7A to 7C is omitted, and a fulcrum pin 31*b* projecting downwardly from the lower surface of the case 31 of the developer residual amount sensor SN is provided in place of the fulcrum pin 42*c*.

In FIG. 8A, when the cartridge U2 is pressed against the developer residual amount sensor SN on the elastic member 47 mounted in the sensor holding portion 42 of the sensor holder H from the upper side thereof, the tips of the sensor head 33 and the contact pin 34 are brought into contact with the outer wall of the developer container 11 without the developer residual amount sensor SN being inclined if the outer wall of the developer container 11 is parallel to the sensor inclination direction (the direction connecting the sensor head 33 and the contact pin 34) as in the case of FIG. 7A.

The developer residual amount sensor SN is supported through the elastic member 47 by the sensor supporting face, so that the developer residual amount sensor SN can be readily inclined along the surface of the outer wall of the developer container 11 of the cartridge when the outer wall of the developer container 11 of the cartridge is pressed against the upper surface of the developer residual amount sensor SN. Therefore, the developer residual amount detection face 33*a* can be brought into close contact with the outer wall of the developer container 11.

In FIGS. 8B and 8C, if the outer wall of the developer container 11 is inclined with respect to the sensor inclination direction (the direction connecting the sensor head 33 and the contact pin 34), the developer residual amount detection face 33*a* at the tip of the sensor head 33 and the tip of the contact pin 34 are brought into contact with the outer wall of the developer container 11 under the state that the developer residual amount sensor SN is inclined as in the case of FIGS. 7B, 7C.

Accordingly, as in the case of the first embodiment, according to the second embodiment, not only the developer residual amount detection face 33*a* at the tip of the sensor head 33, but also the tip of the contact pin 34 abut against (come into contact with) the outer wall of the developer container 11, whereby the position of the developer residual amount sensor SN is more stabilized as compared with the case where only the developer residual amount detection face 33*a* abuts against the outer wall of the developer container 11. Particularly when the area of the developer residual amount detection face 33*a* is small, the position of the developer residual amount sensor SN is more liable to be unstable when only the developer residual amount detection face 33*a* is brought into contact with the outer wall of the developer container 11. However, when both the developer residual amount detection face 33*a* and the tip of the contact pin 34 -which are located at separate positions are brought into contact with the outer wall of the developer container 11 as in the case of the first embodiment, the position of the developer residual amount sensor SN can be stabilized.

(Modification of Second Embodiment)

Figure 8E:
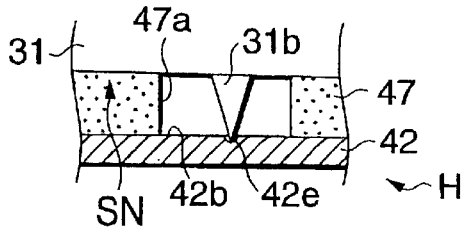
FIG. 8E is an enlarged view showing a main part of FIG. 8D.

In FIGS. 8D and 8E showing a modification of the second embodiment, a recess portion 42*e* is formed on the lower surface of the case 31 of the developer residual amount sensor SN so as to confront the tip of the fulcrum pin 31*b*. The recess portion 42*e* is designed in a semispherical for mn, and the tip portion of the fulcrum pin 31*b* is designed to be sharp.

In the modification of the second embodiment, when the developer residual amount sensor SN is pressed down by the cartridge U2, the tip (lower end) of the fulcrum pin 31*b* is fitted into the recess portion 42*e*. Under this state, the developer residual amount sensor SN can be rotated while the fulcrum pin 31*b* is positioned by the recess portion 42*e*. Accordingly, the developer residual amount sensor SN is not moved, and thus its position is stable.

(Modifications)

The present invention is not limited to the above-described embodiments, and various modifications may be made without departing from the subject matter of the present invention. For example, the following modifications may be made.

In the first embodiment, the fulcrum member is constructed by the fulcrum pin (42*c*) provided to the sensor supporting face (42*b*). However, it may be constructed by a linear projecting member which extends in the direction perpendicular to the rotational axis (Ha) of the sensor holder and is provided on the sensor supporting face (42*b*).

When the developer residual sensor SN is pressed down by the cartridge, the developer residual amount sensor SN can be rotated under the state that it is positioned by the fulcrum member. Accordingly the position of the developer residual sensor SN is not varied and thus is stabilized.

Further, if the sensor holder H is provided with a moving member 48 which is formed of an elastic member or the like, the sensor can be brought into close contact with the outer wall of the cartridge when the cartridge is mounted, and thus it is more preferable.

The holding member for fixedly holding the sensor and the inclination regulating projection member may be properly modified.

It is preferable that the sensor holder H is not fixed to the apparatus body, but is detachably secured to the apparatus body so that it is exchangeable by a new one due to failure or the like.

When the inclination regulating projection member is removed, it may be designed to be rotatable by providing a fulcrum member to the back side of the sensor.

The image forming apparatus of the present invention has the following effect.

There are provided the sensor head which is projected from the cartridge confronting surface and has the tip surface serving as the developer residual amount detection face to be pressed against the outer wall of the developer container, and the inclination regulating projection member which is projected from the cartridge confronting surface at a position away from the sensor head and brought into contact with the outer wall of the developer container, so that the position of the developer residual amount sensor can be stabilized under the state that the developer residual amount detection face of the developer residual amount sensor is brought into close contact with the outer wall of the developer container.

What is claimed is:

1. An image forming apparatus comprising:

an image forming apparatus body having a cartridge mount space in which a cartridge having a developer container filled with developer is detachably mounted;

a sensor that detects a residual amount of the developer and an inclination regulating projection member, which are brought into contact with the outer wall of the developer container when the cartridge is mounted in the cartridge mount space;

a holding member that fixedly holds the sensor and the inclination regulating projection member; and a support member which rotatably supports the holding member so that the sensor and the inclination regulating projection member are positionally variable so as to come into contact with the outer wall of the developer container.

2. The image forming apparatus as claimed in claim 1, further comprising a sensor holder that holds the holding member and the support member.

3. The image forming apparatus as claimed in claim 2, wherein the sensor holder is detachably mounted in the image forming apparatus body.

4. The image forming apparatus as claimed in claim 2, further comprising a moving member that makes the sensor holder movable when the cartridge is mounted in the image forming apparatus body.

5. The image forming apparatus as claimed in claim 1, wherein the support member is located between the sensor and the inclination regulating projection member.

6. An image forming apparatus comprising:

an image forming apparatus body having a cartridge mount space in which a cartridge having a developer container filled with developer is detachably loaded and mounted;

a developer residual amount sensor including a cartridge confronting face that confronts the outer wall of the developer container when the cartridge is mounted in the cartridge mount space, a supported face formed at the opposite side of the cartridge confronting face, a sensor head which is projected from the cartridge confronting face and whose tip end face serves as a developer residual amount detection face to be pressed against the outer wall of the developer container, an inclination regulating projection member which is projected from the cartridge confronting face at a position distant from the sensor head and can come into contact with the outer wall of the developer container, the developer residual amount sensor detecting the amount of the developer in the developer container under the state that the developer residual amount detection face is brought into contact with the outer wall of the developer container;

a sensor supporting face that supports the supported face of the developer residual amount sensor; and a fulcrum member which is projected from one of the sensor supporting face and the supported face of the developer residual amount sensor toward the other face, the fulcrum member including a tip portion and the other face being rotatable with respect to the tip portion of the fulcrum member as a fulcrum under the state that the tip portion of the fulcrum member is brought into contact with the other face.

7. The image forming apparatus as claimed in claim 6, wherein the developer residual amount sensor is parallel to the outer wall of the developer container which is pressed against the developer residual amount detection face and the developer residual amount sensor is rotatable around an axis perpendicular to a line connecting the developer residual amount detection face and the inclination regulating projection member.

8. The image forming apparatus as claimed in claim 7, herein the fulcrum member is constructed by a linear projecting member extending in a direction perpendicular to the rotational axis of the developer residual amount sensor.

9. The image forming apparatus as claimed in claim 6, wherein the fulcrum member comprises a fulcrum pin.

10. The image forming apparatus as claimed in claim 6, further comprising an elastic member which is easily compressible and deformable being located between the supported face of the developer residual amount sensor and the sensor supporting face to hold the developer residual amount sensor, while the developer residual amount sensor is pressed against the elastic member.

11. The image forming apparatus as claimed in claim 6, wherein the sensor supporting face or the supported face of the developer residual amount sensor which confronts the tip of the fulcrum member is provided with a recess portion or a through hole on the surface thereof.

12. A sensor holding comprising:

a sensor for detecting a residual amount of developer and an inclination regulating projection member, which are brought into contact with the outer wall of a developer container when a cartridge is mounted in a cartridge mount space of an image forming apparatus body;

a holding member that fixedly holds the sensor and the inclination regulating projection member; and a supporting member that rotatably supports the holding member so that the sensor and the inclination regulating projection member are positionally variable in the height direction thereof.

* * * * *